US008008592B2

(12) United States Patent
Yang et al.

(10) Patent No.: US 8,008,592 B2
(45) Date of Patent: Aug. 30, 2011

(54) SIDE KEY ASSEMBLY FOR PORTABLE ELECTRONIC DEVICE

(75) Inventors: Mu-Wen Yang, Taipei Hsien (TW); Chih-Chiang Chang, Taipei Hsien (TW)

(73) Assignee: FIH (Hong Kong) Limited, Kowloon (HK)

( * ) Notice: Subject to any disclaimer, the term of this patent is extended or adjusted under 35 U.S.C. 154(b) by 317 days.

(21) Appl. No.: 12/478,009

(22) Filed: Jun. 4, 2009

(65) Prior Publication Data

US 2009/0301853 A1 Dec. 10, 2009

(30) Foreign Application Priority Data

Jun. 6, 2008 (CN) ..... 2008 1 0302061

(51) Int. Cl.
*H01H 13/00* (2006.01)

(52) U.S. Cl. ..... 200/343

(58) Field of Classification Search ..... 200/341–345, 200/330, 332, 339, 296
See application file for complete search history.

(56) References Cited

U.S. PATENT DOCUMENTS

| | | | | | |
|---|---|---|---|---|---|
| 4,401,864 | A * | 8/1983 | Ichikawa | 200/17 R |
| 4,689,455 | A * | 8/1987 | Watanabe | 200/534 |
| 5,332,874 | A * | 7/1994 | Orr et al. | 200/5 B |
| 6,239,726 | B1 * | 5/2001 | Saida | 340/999 |
| 6,930,264 | B2 * | 8/2005 | Nagai et al. | 200/252 |
| 7,094,983 | B2 * | 8/2006 | Tsunemoto | 200/339 |
| 7,208,692 | B2 * | 4/2007 | Yamaguchi | 200/547 |
| 7,385,150 | B1 * | 6/2008 | Siddiqui et al. | 200/5 A |
| 7,554,050 | B1 * | 6/2009 | Lv | 200/339 |
| 7,800,008 | B2 * | 9/2010 | Shi et al. | 200/547 |
| 7,884,297 | B2 * | 2/2011 | Okuzumi | 200/339 |
| 7,916,459 | B2 * | 3/2011 | Lee et al. | 200/5 E |
| 2008/0088489 | A1 * | 4/2008 | Moon | 341/22 |
| 2008/0264768 | A1 * | 10/2008 | Shi et al. | 200/344 |
| 2009/0152088 | A1 * | 6/2009 | Fujiwara | 200/343 |

* cited by examiner

*Primary Examiner* — Briggitte R Hammond
(74) *Attorney, Agent, or Firm* — Altis Law Group, Inc.

(57) ABSTRACT

A side key assembly comprises a base plate, a first push button and a second push button. The base plate has an opening defined therein and two opposite sidewalls defined in the opening. The first push button is rotatably assembled to the base in the opening, and the first push button is situated adjacent to one of the sidewalls. The second push button is rotatably assembled to the first push button in the opening and the second push button is situated adjacent to another sidewall.

20 Claims, 4 Drawing Sheets

SIDE KEY ASSEMBLY FOR PORTABLE ELECTRONIC DEVICE

CROSS-REFERENCE TO RELATED APPLICATIONS

This application is related to co-pending U.S. patent application 12/478,011, entitled "SIDE KEY ASSEMBLY FOR PORTABLE ELECTRONIC DEVICE", by Mu-Wen Yang et al. Such application has the same assignee as the present application and has been concurrently filed herewith. The above-identified application is incorporated herein by reference.

BACKGROUND

1. Technical Field

The present disclosure generally relates to side key assemblies, and particularly to side key assemblies used in portable electronic devices.

2. Description of Related Art

With the development of the smaller and lighter electronic devices for portable use, side key assemblies become more compact with individual keys more tightly spaced. Unfortunately, users of these portable electronic sometimes experience difficulty in activating keys that are close together; multiple and/or erroneous keys may be activated at the same time. This drawback exists not only in cellular telephones, but other portable electronic devices with side key assemblies. Also, keys on the side key assemblies can be too crowded to allow quick, accurate activation.

Thus, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary side key assembly and portable electronic device using the side key assembly. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
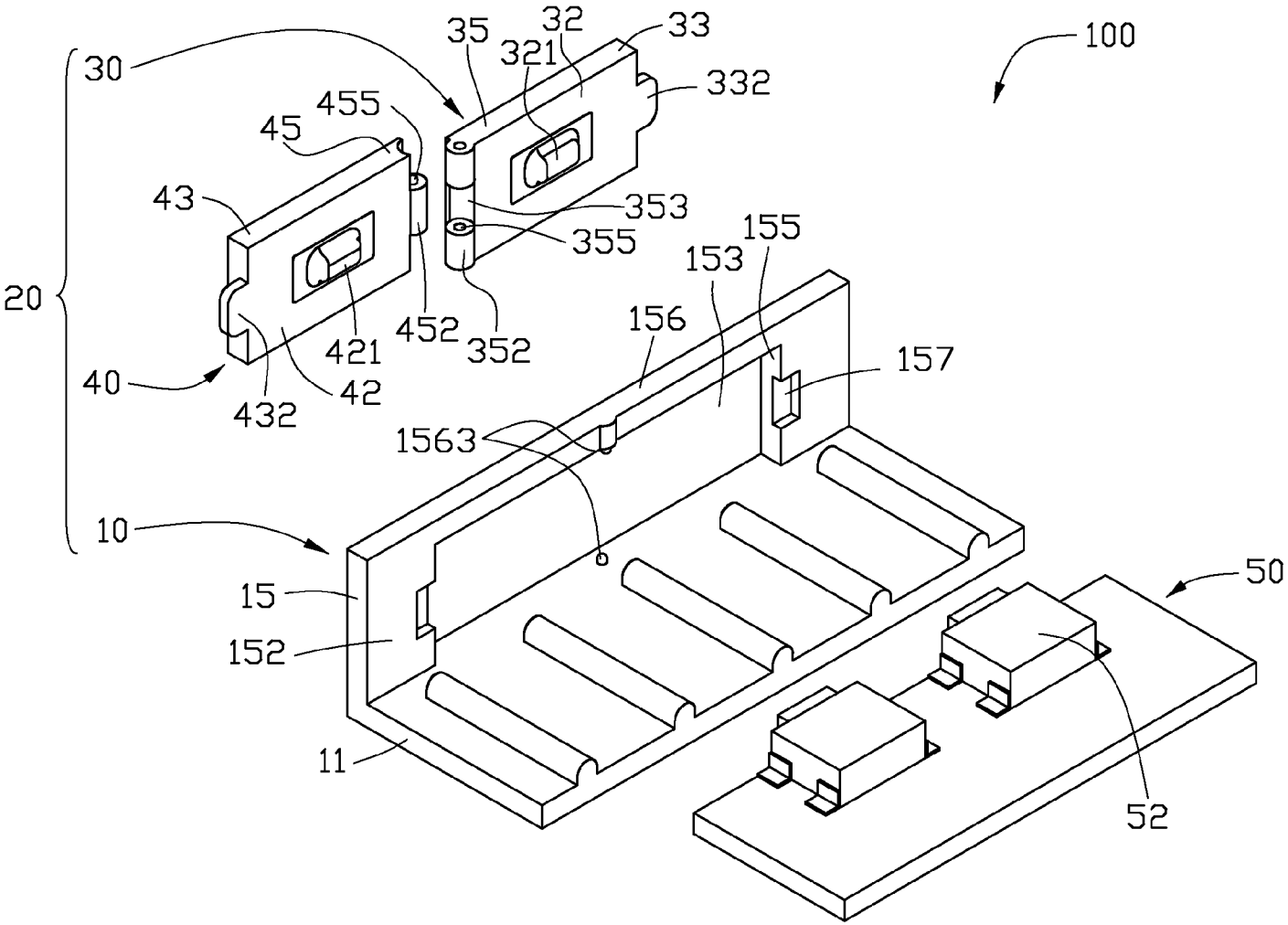
FIG. 1 is an exploded, isometric view of an embodiment of a side key assembly used in a portable electronic device, the portable electronic device including the side key assembly, a housing, and a circuit board.
Figure 2:
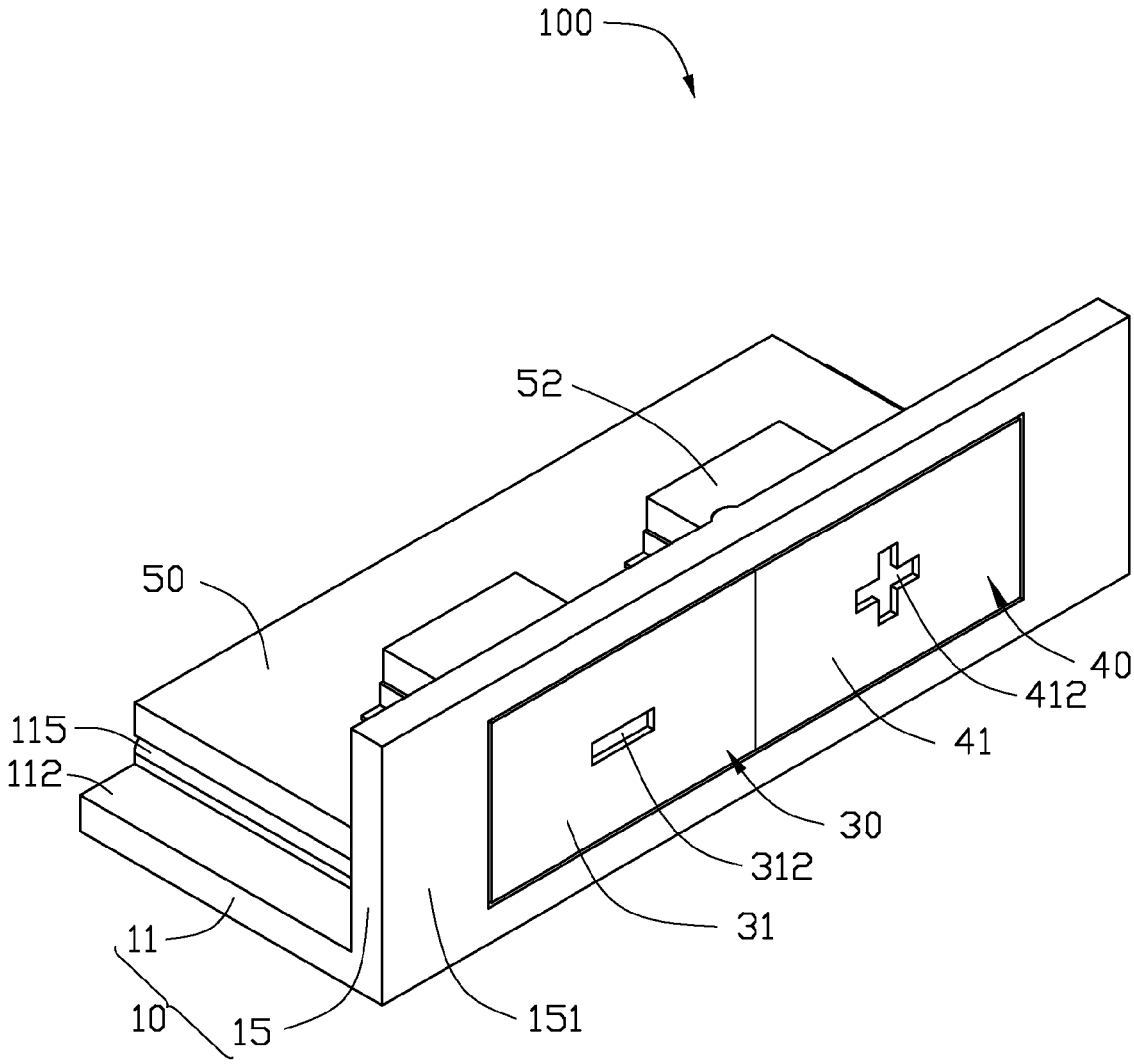
FIG. 2 is an assembled view of the portable electronic device shown in FIG. 1.

Referring to FIGS. 1 to 2, an embodiment of a side key assembly 20 can be used on a portable electronic device 100, such as a cellular phone or any electronic device where a side key is desirable. The portable electronic device 100 includes a circuit board 50 and a side key assembly 20. The exemplary circuit board 50 as shown has two spaced-apart switches 52 mounted thereon.

The side key assembly 20 includes a base plate 10 and push buttons corresponding to the switches 52. The base plate 10 may be a portion of a housing of the portable electronic device 100 or may be a separate element mounted to a housing of the portable electronic device 100. In this embodiment, the base plate 10 is a portion of a housing of the portable electronic device 100. The number of push buttons is the same as the number of switches 52. In this embodiment, the push buttons include a first push button 30 mounted to the base plate 10 and a second push button 40 mounted to first push button 30.

While first push button 30 is shown herein as substantially rectangular, other shapes such as trapezoidal, inverted parabolic, or semi-circular may be substituted. The first push button 30 has a first surface 31 facing the outside of the portable electronic device 100, and a second surface 32 opposite to the first surface 31, a first end portion 33 and a second end portion 35 opposite to the first end portion 33. The first surface 31 is an operating surface of the first push button 30. The first surface 31 may have a first indicia 312 defined thereon, to indicate the function of the first push button 30. The first indicia 312 may be "–", indicating decreased volume function. The second surface 32 has a first push portion 321 protruding from substantially the center thereof. The first push portion 321 may be constructed from injection-molded thermoplastic elastomer and configured to produce a point contact sensation for tactile feedback when a user presses the first push button 30.

The first end portion 33 has a first stopping section 332 protruding outwardly therefrom. The first stopping section 332 is configured for preventing the first push button 30 from detaching from the base plate 10. The second end portion 35 is adjacent to the second push button 40 and has two first hinged portions 352 protruding therefrom. The two first hinged portions 352 are situated apart from each other, so a receiving portion 353 is defined between the first hinged portions 352. Each first hinged portion 352 has a circular hole 355 defined therethough, and the two holes 355 are aligned with each other.

While second push button 40 is shown herein as substantially rectangular, other shapes such as trapezoidal, inverted parabolic, or semi-circular may be substituted. The second push button 40 has a third surface 41 facing away the circuit board 50, and a fourth surface 42 opposite to the third surface 41, a third end portion 43 and a fourth end portion 45 opposite to the third end portion 43. The third surface 41 is an operating surface of the second push button 40. The third surface 41 may have a second indicia 412 defined thereon, to indicate the function of the second push button 40. The second indicia 412 may be "+", indicating increased volume function. The fourth surface 42 has a second push portion 421 protruding from the center thereof. The second push portion 421 may be constructed from injection-molded thermoplastic elastomer and constructed to produce a point contact sensation for tactile feedback when a user presses the second push button 40.

The third end portion 43 has a second stopping section 432 protruding outwardly. The second stopping section 432 has the same shape and size as the first stopping section 332. The second stopping section 432 is configured for preventing the second push button 40 from detaching from the base plate 10. The fourth end portion 45 is adjacent to the first push button 30 and has a second hinged portion 452 protruding therefrom. The second hinged portion 452 has two circular first poles 455 protruding from two ends thereof. The first poles 455 are accommodated in the holes 355 of the first hinged portion 352 to assemble the second push button 40 to the first push button 30*s*. The end portion of the first pole 455 is rounded, thus the first poles 455 can be easily accommodated in the holes 355 of the first push button 30.

The base plate 10 includes a bottom wall 11 and a peripheral wall 15 perpendicularly connected with the bottom wall 11. The bottom wall 11 receives the circuit board 50 thereon. The peripheral wall 15 has an outer surface 151 and an inner surface 152 opposite to the outer surface 151. The peripheral wall 15 defines an opening 153 through the outer surface 151 and the inner surface 152. Thus, two sidewalls 155 situated perpendicularly to the bottom wall 11 are defined and a cantilever 156 situated parallel to and apart from the bottom wall 11 is defined. The cantilever 156 connects the sidewalls 155. The opening 153 is configured for accommodating the side key assembly 20.

Each sidewall 155 has a groove 157 defined therein, and the grooves 157 communicate with the inner surface 152 of the peripheral wall 15. The grooves 157 have the same shape and size as the first stopping section 332. One groove 157 receives the first stopping section 332 therein to prevent the first push button 30 from detaching from the opening 153 of the base plate 10. Another groove 157 receives the second stopping section 432 to prevent the second push button 40 from detaching from the opening 153 of the base plate 10.

The base plate 10 further includes two columnar symmetrical second poles 1563, one of which protrudes from the side of the cantilever 156 and faces the bottom wall 11, and the other of which protrudes from the bottom wall 11 of the base plate 10. The second poles 1563 are accommodated in the holes 355 of the first push button 30 to assemble the first push button 30 to the base plate 10. The end portion of each second pole 1563 is rounded, thus the second poles 1563 can be easily accommodated in the holes 355 of the first push button 30.

Figure 3:
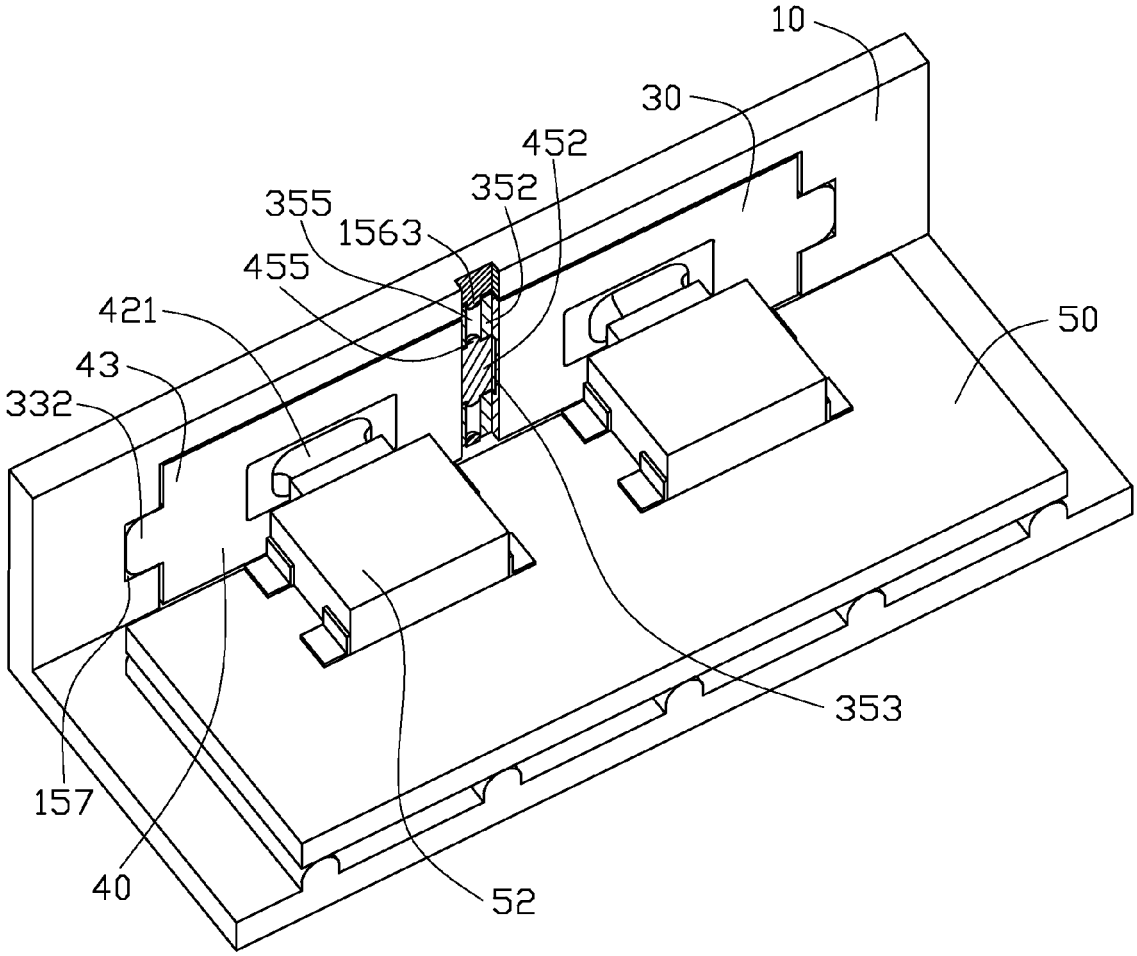
FIG. 3 is a cutaway view of the portable electronic device shown in FIG. 2.

Referring to FIGS. 2 and 3, in assembly of the portable electronic device 100, the first poles 455 are rotatably accommodated in the holes 355 of the first push button 30 to assemble the second push button 40 to the first push button 30. At this time, the second hinged portion 452 is received in the receiving portion. The second poles 1563 are rotatably accommodated in the holes 355 of the first push button 30 to assemble the first push button 30 to the base plate 10. The first push button 30 and the second push button 40 are received in the opening of the base plate 10, and first stopping section 332 and second stopping section 432 are correspondingly accommodated in the groove 157. Next, the circuit board 50 is mounted to the bottom wall 11 of the base plate 10, thus forming an assembled portable electronic device 100. At this time, one switch 52 is situated in front of the first push button 30, and another switch 52 is situated in front of the second push button 40.

Figure 4:
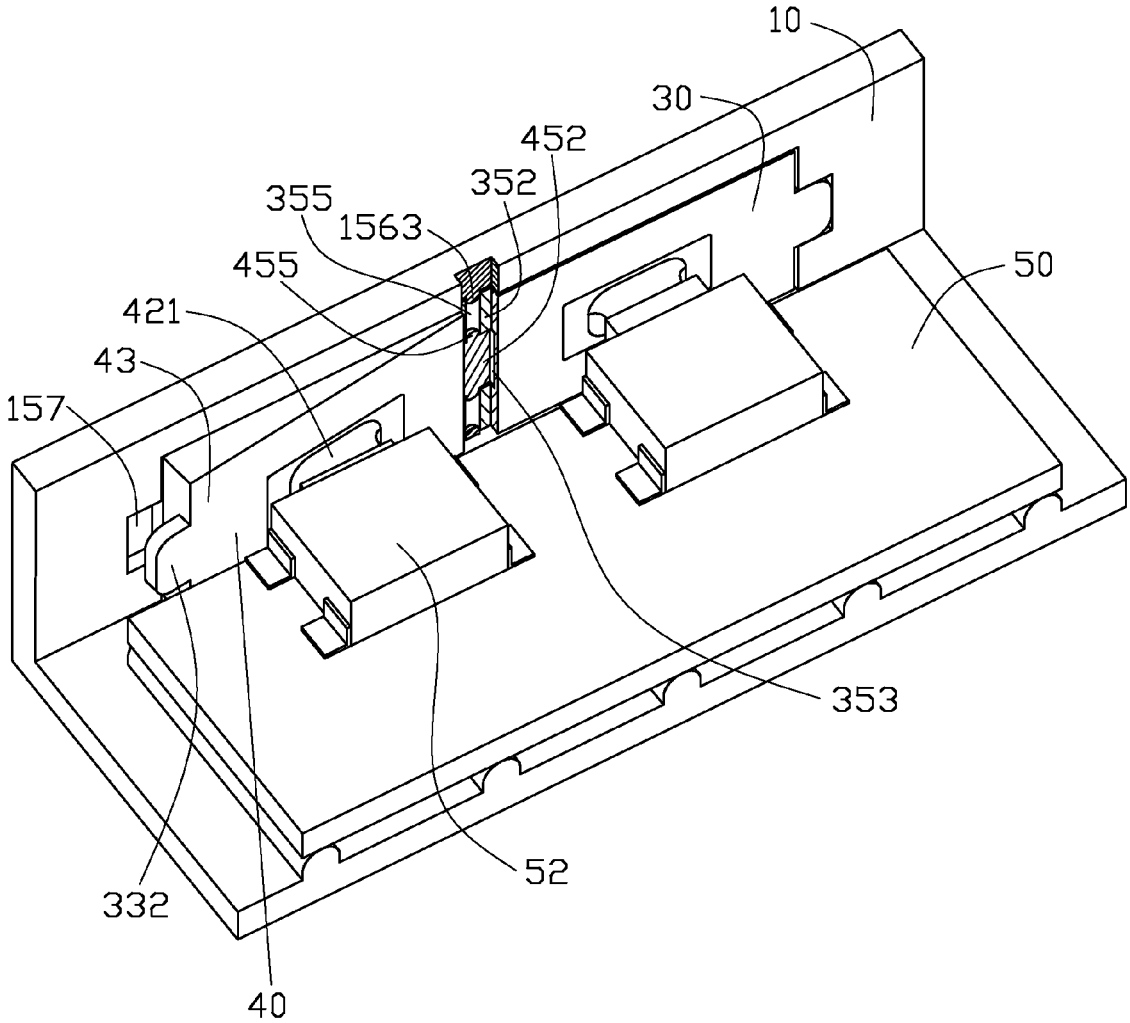
FIG. 4 is similar to FIG. 3, but with a push button is pressed to a switch.

Use of first push button 30 is similar to the second push button 40, thus use of second push button 40 is used to illustrate use of side key assembly 20 here. Referring to FIGS. 3 and 4, use of the second push button 40 comprises third end portion 43 of the second push button 40 being moved toward the switch 52 of the circuit board 50, such that the first poles 455 rotate in the holes 355 to rotate second push button 40 about the second hinged portion 452. Third end portion 43 is continuously moved to rotate third end portion 43 out of the opening 153, until the second push portion 421 of the second button 50 triggers the switch 52 to control the circuit board 50. At this time, the second stopping portion is moved out of the groove 157, and second push button 40 is compressed to provide noticeable tactile sensation to a user. Once the switch 52 is triggered, the first push button 30 is released. Next, the first push button 30 is inversely rotated about the second hinged portion 452 as the switch 52 returns to its original state, until the third end portion 43 53 returns in the opening 153, and the second stopping portion is received in the groove to prevent the second push button 40 from moving away from the base plate 10.

The first push button 30 and the second push button 40 are spaced by the first hinged portion 352 and the second hinged portion 452, such that only one push button is contacted at a time. Additionally, the first push button 30 is articulated with second push button 40, which allows for quick accurate activation of the side key assembly 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A side key assembly comprising:

a base plate defining an opening having two opposite sidewalls;

a first push button, rotatably assembled to the base plate in the opening, and adjacent to one sidewall; and a second push button, rotatably assembled to the first push button in the opening, and adjacent to the other sidewall.

2. The side key assembly of claim 1, wherein the first push button comprises two first hinged portions spaced from each other and facing the second push button, and the second push button comprises a second hinged portion disposed between the first hinged portions, the first hinged portions are articulated with the second hinged portion.

3. The side key assembly of claim 2 wherein each first hinged portion has a hole defined therethrough, and the second hinged portion has two first poles protruding from two ends thereof, with the poles rotatably accommodated in the holes.

4. The side key assembly of claim 3, wherein the cross-section of the hole is circular, and the cross-section of the first pole has the same shape and size as the cross-section of the hole.

5. The side key assembly of claim 4, wherein the end portion of each first pole is rounded, enabling the first poles to be received in the holes of the first push button.

6. The side key assembly of claim 3, wherein the base plate comprises two symmetrical second poles opposite to each other, the first hinged portions disposed between the second poles, and the second poles rotatably accommodated in the holes of the first hinged portion.

7. The side key assembly of claim 6, wherein the base plate includes a bottom wall and a peripheral wall connecting with the bottom wall, the opening defined in the peripheral wall, a cantilever defined in the opening and situated parallel to and apart from the bottom wall, one second pole protruding from the cantilever and facing the bottom wall, and the other protruding from the bottom wall and facing the cantilever.

8. The side key assembly of claim 7, wherein the end portion of each second pole is rounded, such that the second poles are easily accommodated in the holes of the first push button.

9. The side key assembly of claim 6, wherein the cross-section of hole is circular, and the cross-section of the second pole has the same shape and size as the cross-section of the hole.

10. The side key assembly of claim 2, wherein the first push button has a first stopping portion opposite to the first hinged portions, the base plate has a groove defined in a sidewall situated adjacent to the first push button, and the first stopping portion is received in the groove to prevent the first push button from detaching from the opening.

11. The side key assembly of claim 10, wherein the second push button has a second stopping portion opposite to the second hinged portions, the base plate has another groove defined in the sidewall situated adjacent to the second push button, and the second stopping portion is received in the another groove to prevent the second push button from detaching from the opening.

12. A portable electronic device, comprising:

a circuit board having switches mounted thereon; and a side key assembly comprising:

a base plate defining an opening having two opposite sidewalls;

a first push button, rotatably assembled to the base in the opening, and adjacent to one sidewall; and a second push button, rotatably assembled to the first push button in the opening, and adjacent to the other sidewall.

13. The portable electronic device of claim 12, wherein the first push button comprises two first hinged portions spaced from each other and facing the second push button, and the second push button comprises a second hinged portion disposed between the first hinged portions, the first hinged portions are articulated with the second hinged portion.

14. The portable electronic device of claim 13 wherein each first hinged portion has a hole defined therethrough, and the second hinged portion has two first poles protruding from two ends thereof, with the poles rotatably accommodated in the holes.

15. The portable electronic device of claim 14, wherein the cross-section of the hole is circular, and the cross-section of the first pole has the same shape and size as the cross-section of the hole.

16. The portable electronic device of claim 15, wherein the end portion of each first pole is rounded, enabling the first poles to be received in the holes of the first push button.

17. The portable electronic device of claim 14, wherein the base plate comprises two symmetrical second poles opposite to each other, the first hinged portions disposed between the second poles, and the second poles rotatably accommodated in the holes of the first hinged portion.

18. The portable electronic device of claim 17, wherein the base plate includes a bottom wall and a peripheral wall connecting with the bottom wall, the opening defined in the peripheral wall, a cantilever defined in the opening and situated parallel to and apart from the bottom wall, one second pole protruding from the cantilever and facing the bottom wall, and the other protruding from the bottom wall and facing the cantilever.

19. The side key assembly of claim 18, wherein the end portion of each second pole is rounded, such that the second poles are easily accommodated in the holes of the first push button.

20. The side key assembly of claim 17, wherein the cross-section of hole is circular, and the cross-section of the second pole has the same shape and size as the cross-section of the hole.

* * * * *